US005282420A

United States Patent [19]

Hara et al.

[11] Patent Number: 5,282,420

[45] Date of Patent: Feb. 1, 1994

[54] APPARATUS FOR CLEANING PRINTING MACHINE CYLINDER OR THE LIKE

[75] Inventors: Akira Hara, Tokyo; Yasuo Sone, Sizuoka, both of Japan

[73] Assignee: Baldwin Printing Controls Limited, North Point, Hong Kong

[21] Appl. No.: 952,579

[22] Filed: Sep. 28, 1992

[51] Int. Cl.[5] ..... B41F 35/00; B41L 41/00

[52] U.S. Cl. ..... 101/425; 15/256.51; 101/423

[58] Field of Search ..... 101/425, 417, 418, 423, 101/424.1, 424.2; 15/256.51; 355/300

[56] References Cited

U.S. PATENT DOCUMENTS

| | | | |
|---|---|---|---|
| 4,058,059 | 11/1977 | Moestue | 101/425 |
| 4,135,448 | 1/1979 | Moestue | 101/425 |
| 4,416,537 | 11/1983 | Gundlach | 355/300 |
| 4,651,664 | 3/1987 | Kaempfe et al. | 101/423 |
| 4,948,274 | 8/1990 | Mannino | 400/196.1 |
| 4,961,656 | 10/1990 | Surti | 400/196.1 |
| 5,105,740 | 4/1992 | Loos et al. | 101/423 |
| 5,177,544 | 1/1993 | Kimura et al. | 400/624 |

FOREIGN PATENT DOCUMENTS

| | | |
|---|---|---|
| 56-37068 | 8/1981 | Japan . |
| 56-37069 | 8/1981 | Japan . |
| 233306 | 7/1990 | Japan . |
| 215533 | 8/1991 | Japan . |

*Primary Examiner*—Edgar S. Burr
*Assistant Examiner*—Lynn D. Hendrickson
*Attorney, Agent, or Firm*—Morgan & Finnegan

[57] ABSTRACT

An apparatus for cleaning a printing machine cylinder or the like by pressing a cleaning cloth against the outer periphery of the cylinder or the like is disclosed. The apparatus includes a cloth unit assembly including a cloth cassette and a cloth unit. The cleaning cloth is accommodated in the cloth cassette, and the cloth unit has a space for accommodating the cloth cassette. The cloth unit is provided with pressurizing means for pressing the cleaning cloth fed from the cloth cassette against the cylinder or the like. The cloth cassette has an engagement projection specifying the kind of the cylinder to be cleaned, while the cloth unit has an engagement projection matched to the engagement recess of the cloth cassette. If the engagement recess of the cloth cassette accommodating the cleaning cloth is matched to the engagement projection of the cloth unit, the cloth cassette can be loaded in the cloth unit, whereby the cleaning cloth conforming to the specifications of the cylinder to be cleaned can be supplied.

5 Claims, 6 Drawing Sheets

APPARATUS FOR CLEANING PRINTING MACHINE CYLINDER OR THE LIKE

FIELD OF THE INVENTION

This invention relates to an apparatus for cleaning the outer peripheral surface of a cylinder in a printing machine such as cylinders, rollers, or the like.

DESCRIPTION OF THE PRIOR ART

In a prior art apparatus for automatically cleaning printing machine cylinders or the like, a cleaning cloth passed between a supply roller and a take-up roller is used to wipe out ink, paper dust or the like from the surface of a cylinder or the like. Thus, the apparatus has pressurizing means for pressing the cleaning cloth fed from the supply roller against the cylinder surface. This pressurizing means is moved in a timed relation to the cleaning operation. Various such apparatuses for automatically cleaning printing machine cylinders or the like have been proposed and used, and some of them are disclosed in, for instance, Japanese Patent Publication No. 37068/1981, Japanese Patent Publication No. 37069/1981 and Japanese Patent Publication No. 33306/1990.

FIG. 6 shows an example of the prior art automatic cleaning apparatus. Referring to the Figure, a cloth unit 60 serves to wash a blanket cylinder (hereinafter referred to as cylinder), which is a kind of printing machine cylinder. The cloth unit includes a supply roller 61 for supplying a cleaning cloth 64 and a take-up roller 63 for taking up the same. The cleaning cloth 64 is passed round a pressure pad 62 and between the two rollers 61 and 63. The pressure pad 62 is pressed against and separated from the cylinder surface 51 by an actuator (not shown). During normal printing operation, the pressure pad 62 is held separated from the cylinder surface 51.

During cleaning, the cylinder 50 is rotated at a low speed (lower than the speed during the normal printing operation) in the direction of arrow 52. According to a cleaning start signal, the pressure pad 62 is moved toward the cylinder 50, i.e., in the direction of arrow "a". As a result, the cleaning cloth 64 is pressed against the cylinder. The cleaning cloth 64 is wetted with a solvent by a solvent spray unit (not shown) and is also fed continuously or intermittently by the take-up roller 63 in the direction of arrow 65, thus wiping away contaminants from the cylinder. After the lapse of several multiples of ten seconds or several minutes, the cylinder becomes clean. At this instant, the pressure pad 62 is moved in the direction of arrow "b", thus separating the cleaning cloth 64 from the cylinder 50. Also at this moment, the feed operation of the take-up roller 63 is stopped, thus bringing an end to the cleaning operation.

The automatic cleaning apparatus having the above-described construction, which has initially been developed as apparatus for automatically cleaning a printing machine cylinder, has become used for cleaning pressure rollers, ink rollers and guide rollers as printing machine cylinders as well. In this case, different kinds of cleaning cloth are used for different cylinders as the subject of cleaning. However, the shape and structure of the cleaning cloth supply and take-up rollers are the same for different kinds of cleaning cloth. This frequently results in erroneous use of cleaning cloth. For example, a cleaning cloth used for an apparatus for cleaning a printing machine ink supply roller disclosed in Japanese Patent Application Public Disclosure No. 215533/1991 has a thickness of 2 to 3 mm while the thickness of the cleaning cloth used for other automatic cylinder cleaning apparatus is 0.2 mm.

SUMMARY OF THE INVENTION

An object of the invention is to provide an apparatus for cleaning printing machine cylinders or the like, which permits prompt and accurate replenishment with exclusive cleaning cloth conforming to the specifications of different cylinders or the like to be cleaned.

According to the invention, the cloth cassette is provided with an engagement recess conforming to the specifications of a pertaining kind of cylinder, while a cassette accommodation space in a cloth unit is provided with an engagement projection to be matched with the engagement recess noted above, thus avoiding troubles due to use of an impertinent cloth cassette. In addition, since the cloth cassette is loaded by causing engagement of the engagement recess of the cloth cassette and the engagement projection of the cloth unit with each other, the cleaning cloth can be taken out correctly. This permits prompt and accurate replacement of the cleaning cloth.

As a preferred mode of the invention, in an apparatus for cleaning the surface of a printing machine cylinder or the like by pressing a cleaning cloth passed between cleaning cloth supply means for supplying the cleaning cloth and cleaning cloth take-up means for taking up the cleaning cloth against the outer periphery of the printing machine cylinder or the like with pressurizing means, the cleaning cloth supply means comprises a cloth unit assembly including a cloth cassette accommodating the cleaning cloth and a cloth unit having a space for accommodating the cloth cassette, the pressurizing means is provided at the front of the cloth unit, and the cloth cassette accommodation space is provided at the back of the cloth unit. The cloth cassette is provided with an engagement recess conforming to the specifications of the printing machine cylinder or the like to be cleaned, while the cloth unit is provided with an engagement projection matched to the engagement recess of the cloth cassette.

In the replacement of the cloth cassette, if the engagement projection of the cloth cassette and the engagement projection of the cloth unit are matched, it is determined that the cloth which is accommodated in the cloth cassette is for cleaning the cylinder, for which the cleaning apparatus is designed. Thus, it is possible to prevent cleaning troubles with impertinent cleaning cloth. Further, the engagement recess of the cloth cassette specifies the cylinder as the subject of cleaning and permits the cloth cassette to be distinguished clearly from the cloth cassettes for different kinds of cylinders. It is thus possible to improve the efficiency of the cleaning operation.

BRIEF DESCRIPTION OF THE DRAWINGS

The above and other objects, features and advantages of the invention will become more apparent from the following description when the same is read with reference to the accompanying drawings, in which:

FIG. 6 is a schematic view showing a prior art apparatus for automatically cleaning a printing machine cylinder or the like.

DETAILED DESCRIPTION OF THE INVENTION

Figure 1:
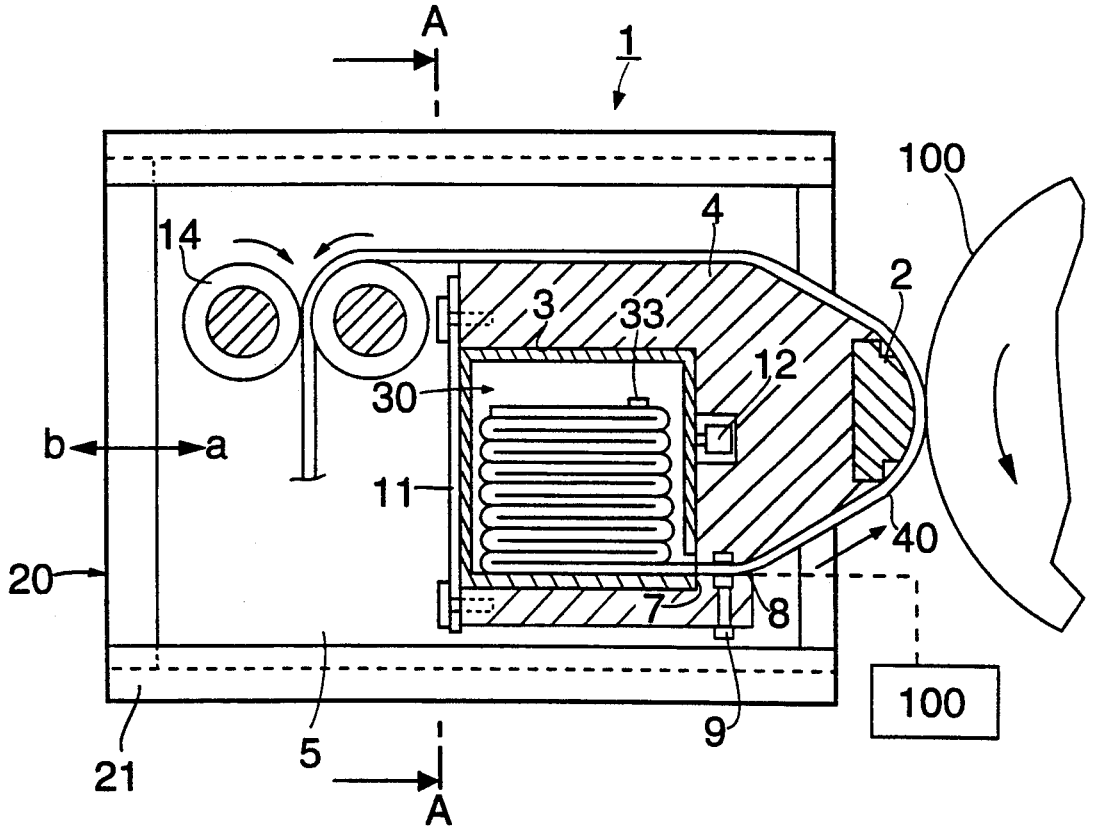
FIG. 1 is a fragmentary sectional view showing an apparatus for automatically cleaning a printing machine cylinder or the like according to the invention.

FIG. 1 schematically shows an apparatus for automatically cleaning a printing machine cylinder or the like according to the invention. The apparatus comprises a cloth unit assembly 1 which includes a cloth unit 4. The cloth unit 4 includes a pressing member 2 of an elastic material at the front of the cloth unit and a cassette accommodation space 3 at the back of cloth unit.

Figure 2:
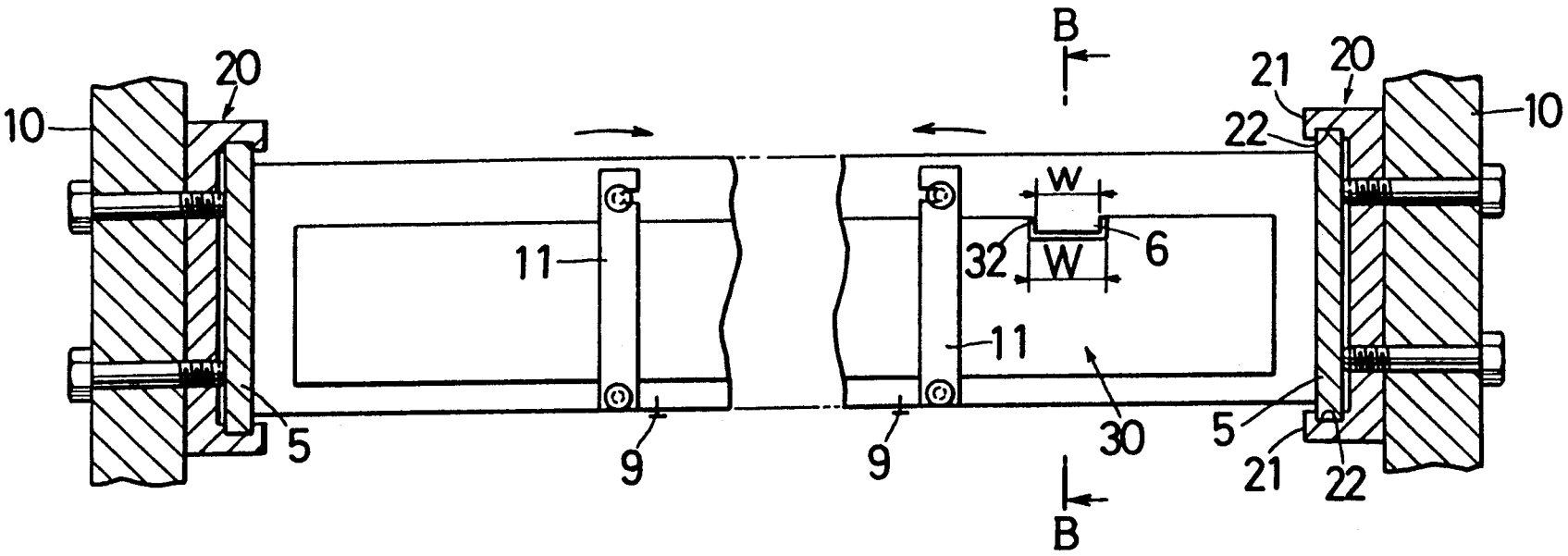
FIG. 2 is a back view taken along line A—A in FIG. 1.

The cloth unit assembly 4 has opposed side plates 5, which are supported by adapter plates 20 secured to an apparatus frame 10. Each adapter plate 20 has opposed side plate support portions 21. The opposed side plate support portions 21 have grooves 22 formed on their inner side and opposing each other, the side plate 5 being supported slidably in these grooves 22. Thus, the cloth unit 4 can be moved by an actuator (not shown) toward and away from a cylinder 100, i.e., in the directions of arrows "a" and "b" in FIG. 1. By this movement, cleaning cloth 40 is pressed against and separated from the cylinder. The cassette accommodation space 3 has a rectangular sectional profile and has a cassette insertion opening formed on the back. The body of the cloth unit 4 has an engagement projection 6 projecting into the cassette accommodation space 3 on the side of the cassette insertion opening. The engagement projection 6 is adapted to engage with a cloth cassette 30 having a width w. Through the cloth cassette 30 and the body of the cloth unit 4 is formed a cloth outlet for taking out a cleaning cloth 40 therethrough from the bottom of the cloth cassette 30. The cleaning cloth 40 taken out from the cloth outlet is led by a guide 8 to proceed along the outer surface of the body of the cloth unit 4. As it proceeds the outer surface of the body of the cloth unit 4, it passes by the pressing member 2. The guide 8 is provided with a brake 9 for preventing the taken-out cleaning cloth from sagging and being taken up on the cylinder 100. The brake 9, as shown in FIG. 1, includes a brake shoe operable across the guide 8 and a brake setting screw. The brake 9 is provided at each of two positions as shown in FIG. 2. A retainer 11 is provided for retaining the cloth cassette 30, and a pair of cloth feed rollers 14 are located outside retainer 11.

Figure 3:
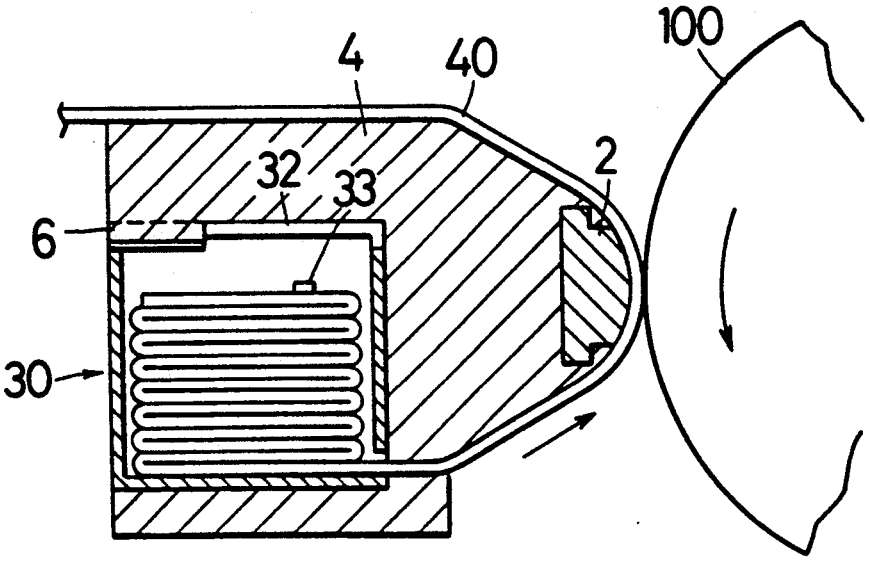
FIG. 3 is a fragmentary sectional view taken along line B—B in FIG. 2.
Figure 4:
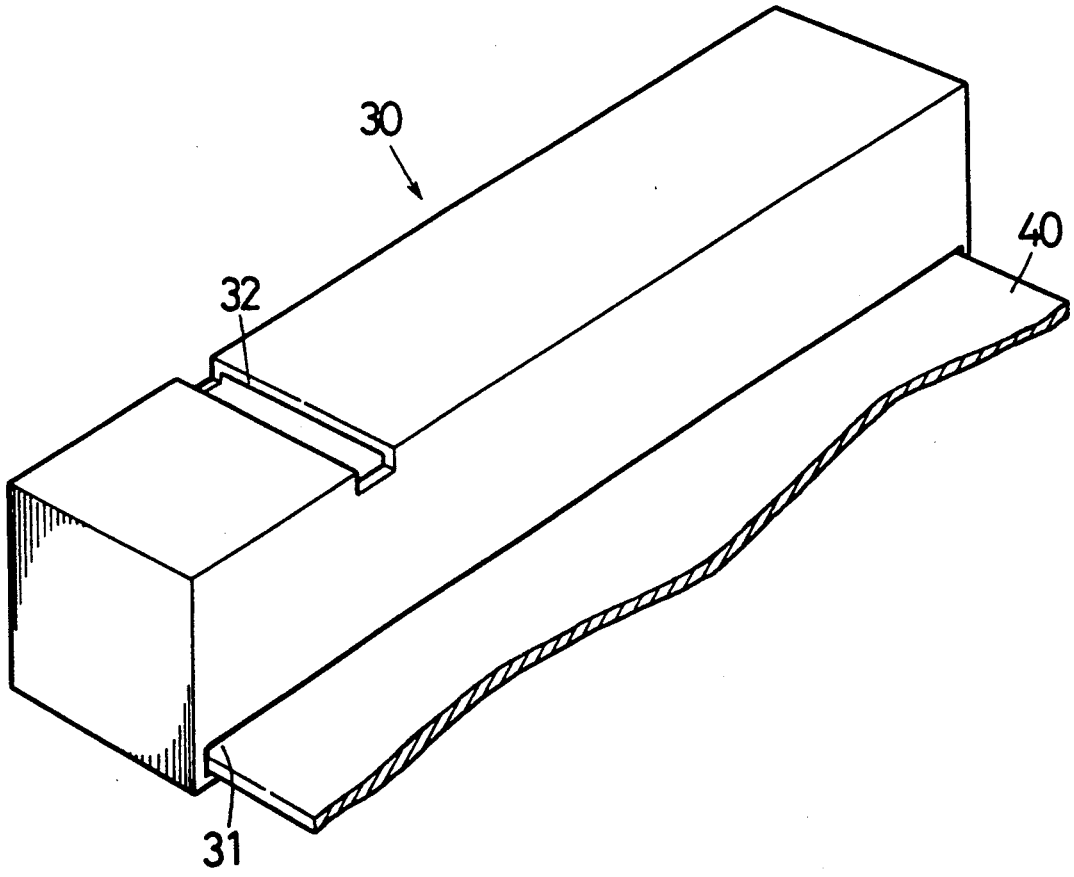
FIG. 4 is a perspective view showing a cloth cassette.

The cloth cassette 30 has the same sectional profile as the cassette accommodation space 3 in the cloth unit 4. The cleaning cloth 40 is accommodated in the cloth cassette 30 in a folded form with folding lines extending horizontally. The cloth cassette 30 is mounted such that the cleaning cloth is taken out to the outside through a cloth outlet 31 provided adiacent its bottom. As safety means for preventing erroneous use of the apparatus for cylinders other than intended ones, the cloth cassette is provided with an engagement recess 32 (see FIG. 3) for engagement with the engagement projection provided in the body of the cloth unit 4. The engagement recess has a width W slightly greater than the width w of the engagement projection.

As other safety means for preventing erroneous use of an inadequate cleaning cloth for the cleaning apparatus, a switch 12 is provided adjacent the cassette accommodation space 3, as shown in FIG. 1, to detect the loading of the cloth cassette 30. It is possible to permit the start of the sequence of operations such as the supply of cleaning liquid and driving of the cloth feed rollers with the operation of the switch 12. As further safety means, a blocking member (designated generally by numeral 100) may be provided such that it can be brought into and retreated from part of the guide 8 and can thereby disable the taking-out of the cleaning cloth from the cloth cassette. This blocking member may be constructed such that in response to the loading of a cloth cassette for an intended cylinder (hereinafter referred to as an exclusive cloth cassette) it is retreated by a mechanical or electrical operating mechanism to permit the taking-out of the cleaning cloth while with other cloth cassettes it is held in its advanced position to disable the taking-out of the cleaning cloth. Further, it is possible to provide other safety means by combining the above switch mechanism and blocking member mechanism, thus providing for a more reliable safety function and enhance the reliability of the apparatus.

Figure 5:
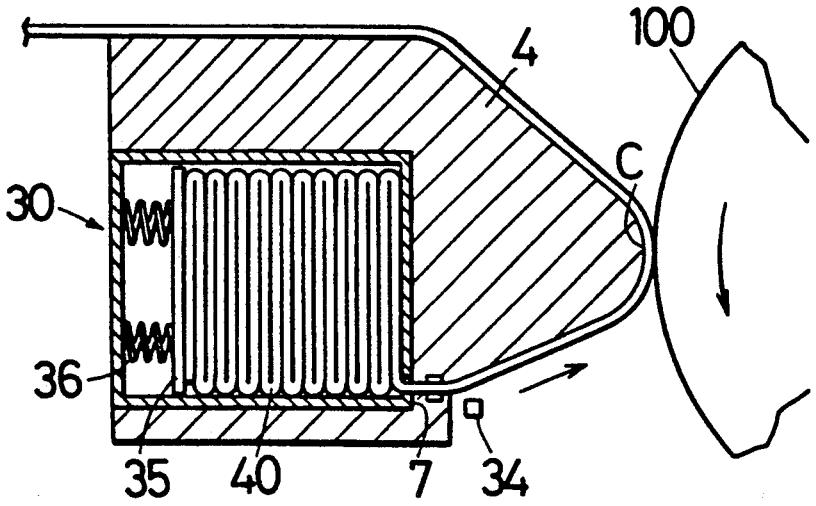
FIG. 5 is a fragmentary sectional view showing a different embodiment of the invention.
Figure 6:
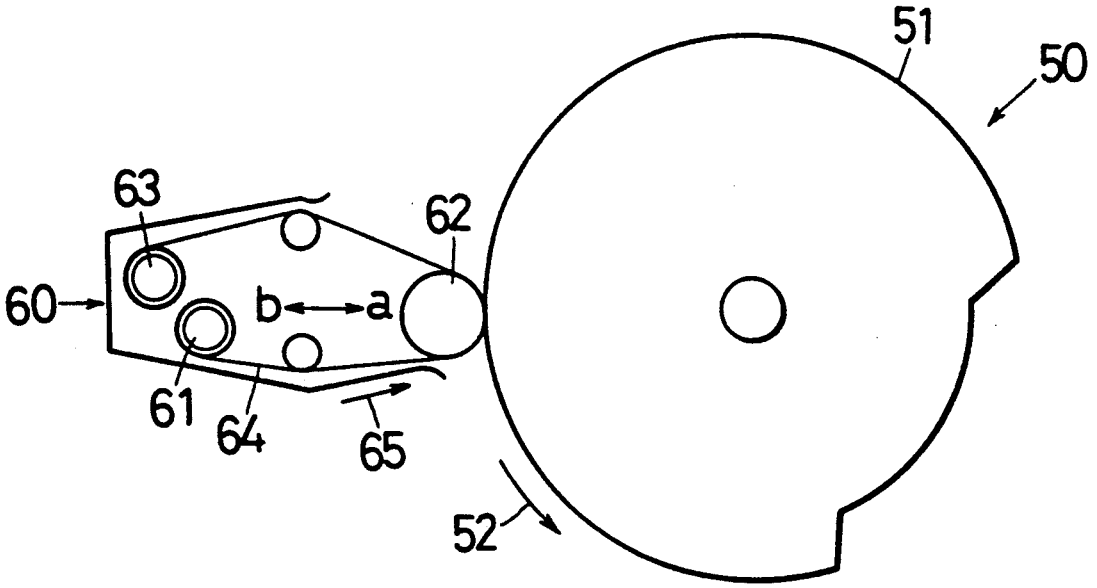

FIG. 5 shows a different example of the cloth cassette. A cleaning cloth is accommodated in the cloth cassette in a folded fashion with folding lines formed at the top and bottom. In this case, to provide for smooth feed of the cleaning cloth, a back-up plate 35 biased by a spring 36 is applied to the trailing end of the cleaning cloth to urge the whole folded cleaning cloth toward the cloth outlet.

FIG. 1 shows means for detecting the residual amount of cleaning cloth in the cloth cassette. More specifically, the cleaning cloth is provided near its trailing end with a marker 33. The marker 33 is detected with a sensor (not shown) provided in the guide 8. Alternatively, the end of the cleaning cloth or the marker is detected by a sensor 34 provided outside the guide as shown in FIG. 5. Upon detection of the cloth end or marker, the apparatus is stopped.

In the case of FIG. 1, the cleaning cloth 40 is pressed against the cylinder or the like by the pressing member 2. In the case of FIG. 5, it is pressed by a curved end portion (shown at C) of the body of the cloth unit 4.

In operation, when the cleaning of a cylinder, for instance an ink supply roller, is started, an actuator is operated to move the cloth unit 4 in the direction of arrow "a" to urge the cleaning cloth against the surface of the ink supply roller by the pressing member at the front of the cloth unit, thus wiping up ink softened by solvent. At this time, ink is softened by directly providing a solvent to the roller surface or indirectly providing the solvent, i.e., impregnating the cleaning cloth with the solvent. The cleaning cloth may be fed either continuously or intermittently.

The cleaning cloth, having absorbed ink, is thereafter processed in a cloth processing section (not shown), which is provided on the downstream side of the cloth feed rollers and serves to cut or take-up the cloth.

When the supply of cleaning cloth in the cloth cassette is exhausted, the retainer is removed, and the cloth cassette is taken out from the cloth unit and replaced with a new one. At this time, the new cloth cassette is loaded in the cassette accommodation space with its engagement recess engaged with the engagement projection of the cloth unit. When the loading of the cloth cassette is completed, the leading end of the cloth is led out of the cloth outlet and past the guide to the outside of the cloth unit. This cloth end is passed round the pressing member or the front end of the body of the cloth unit and between the cloth feed rollers. Then, the brake is adjusted to provide the cloth with an adequate tension. Then, the cleaning is resumed.

At this time, a cloth cassette which does not conform to the specifications of the system can not be loaded in the cassette accommodation space, and thus it is possible to prevent trouble that might otherwise result from erroneous use of the cloth cassette. Further, with the provision of the safety means, the use of the cleaning cloth is permitted after judgment of the operating condition of the safety means at the time of the loading of the cloth cassette. Thus, the reliability in use can be enhanced.

In the above embodiment, a single set of engagement projection and engagement recess is provided. However, this is by no means limitative. For example, it is possible to provide a plurality of projection and recess sets with at least one of the set having an engagement projection provided in the cloth unit and an engagement recess provided in the cloth cassette.

What is claimed is:

1. An apparatus for cleaning the surface of a printing machine cylinder comprising: a cleaning cloth; cleaning cloth supply means for supplying said cleaning cloth; cleaning cloth take-up means for taking up said cleaning cloth; pressurizing means for engaging said apparatus against the outer periphery of the printing machine cylinder, said cleaning cloth supply means comprising: a cloth unit assembly including a cloth cassette accommodating said cleaning cloth and said cloth unit assembly defining a space for accommodating said cloth cassette, said pressurizing means being provided at the front of said cloth unit assembly, said cloth cassette being provided with an engagement recess dependent upon a specific printing machine cylinder to be cleaned, said cloth unit assembly being provided with an engagement projection matched to said engagement recess of said cloth cassette.

2. The apparatus for cleaning a printing machine cylinder according to claim 1, wherein said cleaning cloth is accommodated in a folded fashion in said cloth cassette.

3. The apparatus for cleaning a printing machine cylinder according to claim 1, wherein said cloth unit assembly includes a brake for tensioning said cleaning cloth.

4. The apparatus for cleaning a printing machine cylinder according to claim 1, wherein said cloth unit assembly and the cloth cassette engaged in said cloth unit assembly are provided with means for determining the presence of a cloth cassette conforming to the printing machine cylinder to be cleaned, said apparatus engaged in a sequence of cleaning operations upon indication of a detection signal from said determining means.

5. The apparatus for cleaning a printing machine cylinder according to claim 1, wherein said cloth unit assembly includes a cleaning cloth guide and a blocking member capable of being advanced into and retreated out of said guide, said blocking member being retreated to permit passage of the cleaning cloth when a cloth cassette conforming to the printing machine cylinder to be cleaned has been loaded in said cloth unit assembly.

* * * * *